US007997961B1

(12) United States Patent
De La Rosa

(10) Patent No.: US 7,997,961 B1
(45) Date of Patent: Aug. 16, 2011

(54) TOOL FOR ELEVATING A SANDER

(76) Inventor: Bobby De La Rosa, Carson, CA (US)

( * ) Notice: Subject to any disclaimer, the term of this patent is extended or adjusted under 35 U.S.C. 154(b) by 275 days.

(21) Appl. No.: 12/266,021

(22) Filed: Nov. 6, 2008

Related U.S. Application Data

(60) Provisional application No. 60/986,006, filed on Nov. 7, 2007.

(51) Int. Cl.
*B24B 23/00* (2006.01)

(52) U.S. Cl. ..... 451/354; 451/523

(58) Field of Classification Search ..... 451/354, 451/523–525
See application file for complete search history.

(56) References Cited

U.S. PATENT DOCUMENTS 4,062,152 A * 12/1977 Mehrer ..... 451/344
4,663,796 A * 5/1987 Helling et al. ..... 15/144.2
4,974,371 A * 12/1990 Conboy ..... 451/356
5,144,774 A * 9/1992 Conboy ..... 451/356
5,885,145 A * 3/1999 O'Mara ..... 451/356
6,468,141 B1 * 10/2002 Conboy et al. ..... 451/354
7,014,546 B1 * 3/2006 Birk ..... 451/355
2004/0180616 A1 * 9/2004 Loveless ..... 451/354
2006/0205331 A1 * 9/2006 Gringer et al. ..... 451/532
2007/0072524 A1 * 3/2007 Wettstein et al. ..... 451/354
2008/0189870 A1 * 8/2008 Dayton et al. ..... 7/167
2008/0250570 A1 * 10/2008 Dayton et al. ..... 7/170

* cited by examiner

*Primary Examiner* — Maurina Rachuba
(74) *Attorney, Agent, or Firm* — Kenneth L Tolar

(57) ABSTRACT

A tool for elevating a sander includes a shaft having an upper end and a lower end. The lower end includes an internally-threaded portion for coupling with the externally-threaded end of a conventional painter's pole, or an accompanying extension pole. Pivotally fastened to the upper end of the shaft is any one of a plurality of removable, interchangeable retaining rings each having a discrete circumference for encircling a power sander. Therefore, a worker can easily manipulate the sander within an elevated area without using a ladder or scaffolding.

6 Claims, 2 Drawing Sheets

TOOL FOR ELEVATING A SANDER

CROSS REFERENCE TO RELATED APPLICATIONS

This application is entitled to the benefit of provisional application No. 60/986,006 filed on Nov. 7, 2007, the specification of which is incorporated herein by reference.

BACKGROUND OF THE INVENTION

The present invention relates to a tool that assists a worker with sanding ceilings or other elevated surfaces.

DESCRIPTION OF THE PRIOR ART

When sanding a ceiling or another elevated surface, a worker must repeatedly ascend and reposition a ladder, which is laborious and inconvenient. Furthermore, the worker must organize the sander's power cord once atop the ladder. Otherwise, the worker must use a battery-powered sander, which is much heavier than AC-powered sanders. Accordingly, there is currently a need for a tool that eliminates many of the aforementioned disadvantages associated with sanding elevated surfaces. The present invention addresses this need by providing a tool formed of an elongated pole that is securable to a sander so that a worker can easily elevate the sander while standing at ground level.

SUMMARY OF THE INVENTION

A tool for elevating a sander includes a shaft having an upper end and a lower end. The lower end includes an internally-threaded portion for coupling with the externally-threaded end of a conventional painter's pole, or an accompanying extension pole. Pivotally fastened to the upper end of the shaft is any one of a plurality of removable, interchangeable retaining rings each having a discrete circumference for encircling a power sander. Therefore, a worker can easily manipulate the sander within an elevated area without using a ladder or scaffolding.

It is therefore an object of the present invention to provide a tool that allows a worker to easily elevate a sander.

It is another object of the present invention to provide a tool that eliminates the laborious and inconvenient task of ascending a ladder when sanding ceilings and other elevated surfaces.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
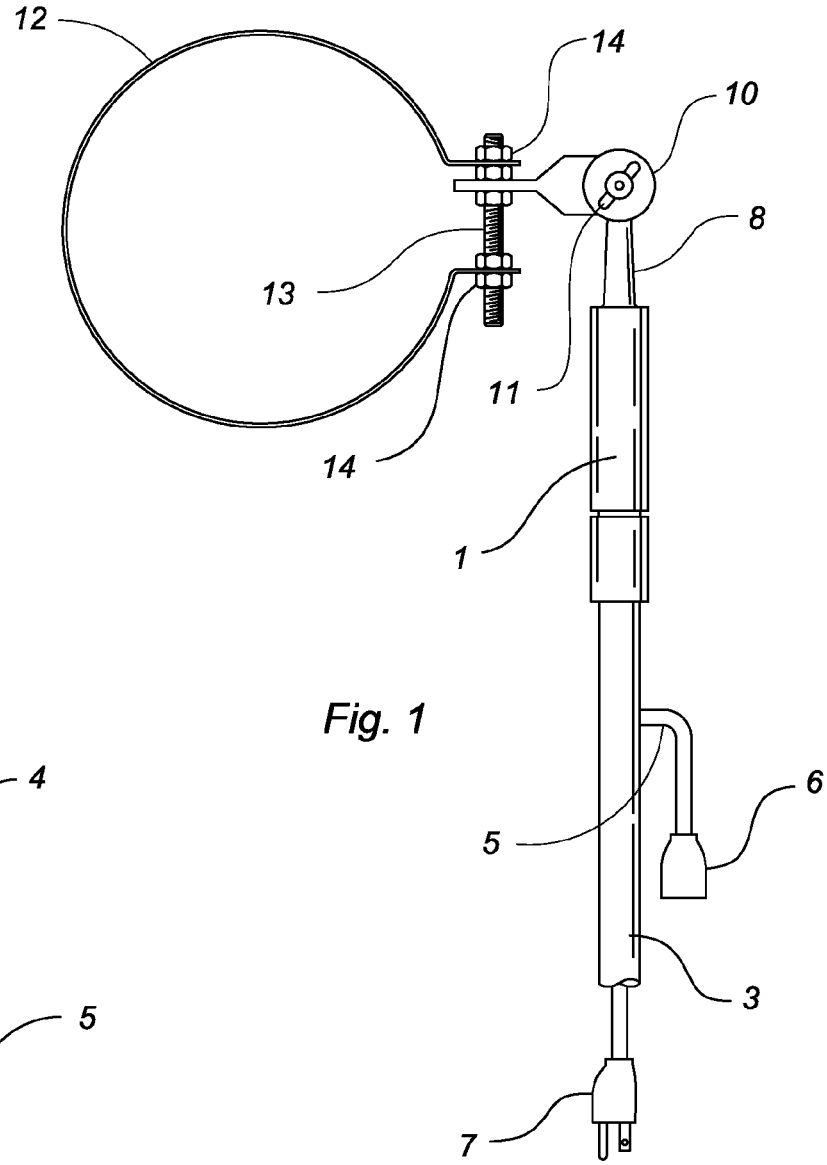
FIG. 1 is a plan view of the tool according to the present invention.
Figure 2:
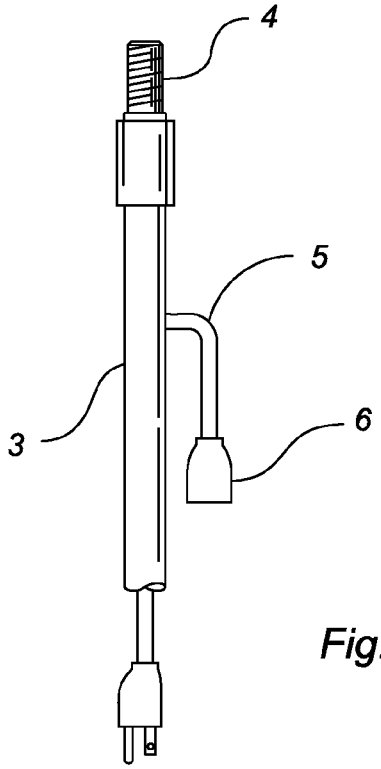
FIG. 2 is an exploded view of the tool depicted in FIG. 1.
Figure 4:
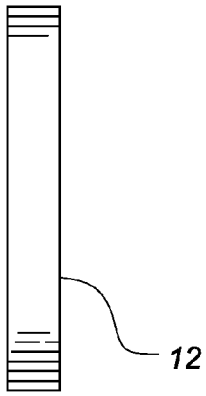
FIG. 4 is a side view of an exemplary retaining ring.
Figure 3:
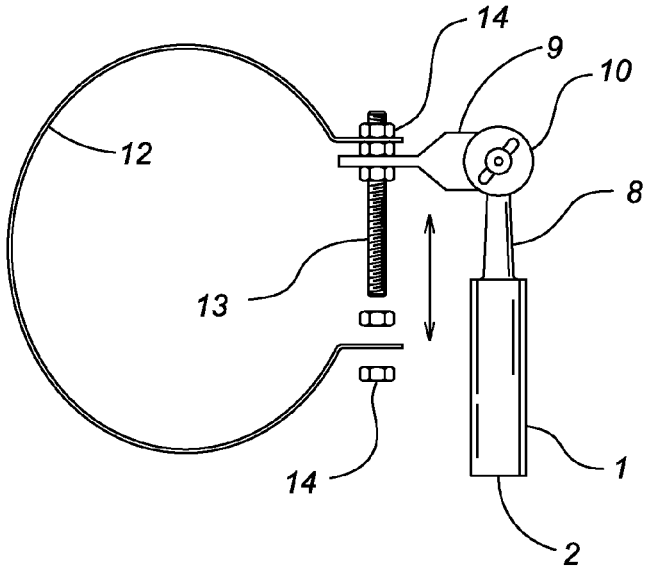
FIG. 3 is a detailed view of the shaft and attached retaining ring.
Figure 5:
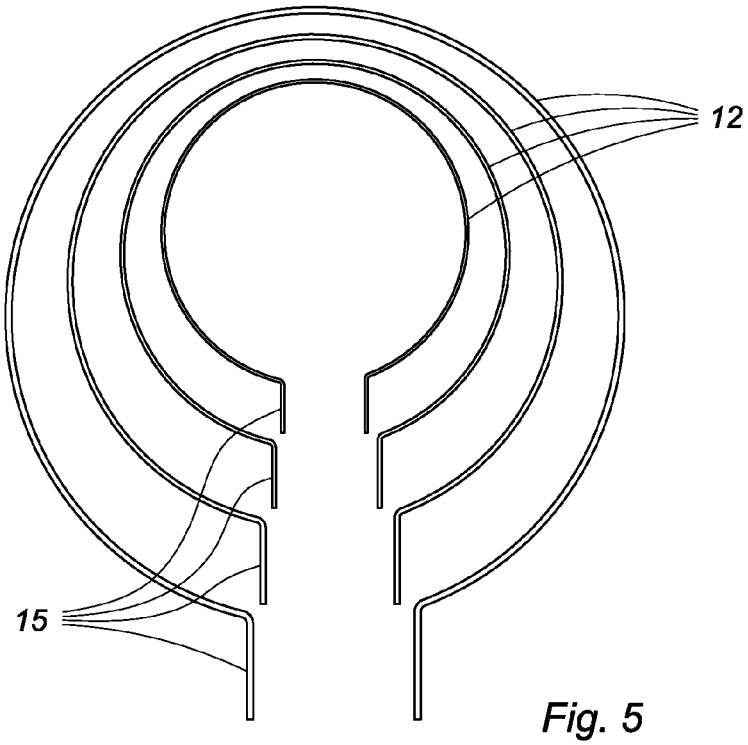
FIG. 5 is a plan view of a plurality of varying diameter retaining rings.

A tool for elevating a sander includes a shaft 1 having an upper end and a lower end. At the lower end is an internally-threaded portion 2 for coupling with the externally threaded end of a conventional painter's pole. Alternatively, an accompanying extension pole 3 may be provided, which includes an externally threaded upper end 4. A power cord 5 is axially received within the extension pole for connecting an elevated sander to a power source. A plug receptacle 6 at an upper end of the cord protrudes from the pole for coupling with the sander's power cord. A plug 7 extends from a lower end of the pole for coupling with a wall receptacle.

Extending from the upper end of the shaft is an arm 8 having a bracket member 9 pivotally attached to a distal end. The arm includes an eyelet 10 having a serrated inner surface that meshes with a serrated outer surface on the bracket. A wing nut 11 secures the two components at a select angle. At a distal end of the bracket is any one of a plurality of removable, interchangeable retaining rings 12 each having a discrete circumference. Each ring has a pair of spaced, free ends 15 that fasten the ring to the bracket using a bolt 13 and associated nuts 14.

Accordingly, the retaining ring is fastened about the outer circumference of a desired sander. The shaft is secured to either an existing painter's pole or the accompanying extension pole. Therefore, a worker can easily manipulate the sander within an elevated area without using a ladder or scaffolding.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A tool for elevating a sander comprising:

a shaft having an upper end and a lower end;

means for securing the lower end of said shaft to an extension pole;

an arm extending from the upper end of the shaft, said arm having a bracket member pivotally attached to a distal end;

a plurality of removable, interchangeable retaining rings each of said rings is removably attached to a distal end of the bracket, each of said rings having a discrete circumference for encompassing a given sized sander.

2. The tool for elevating a sander according to claim 1 wherein said means for securing the lower end of said shaft to an extension pole comprises an internally-threaded portion on the lower end of said shaft, said internally-threaded portion adapted to couple with an externally-threaded end on said extension pole.

3. The tool for elevating a sander according to claim 1 wherein said extension pole includes a power cord axially received therein for providing electricity to an elevated sander.

4. The tool for elevating a sander according to claim 1 wherein said arm includes an eyelet having a serrated inner surface that meshes with a serrated outer surface on said bracket.

5. The tool for elevating a sander according to claim 4 further comprising a fastener means for securing said eyelet and said bracket allowing a relative angle between said bracket and said eyelet to be varied.

6. The tool for elevating a sander according to claim 1 further comprising a power sander encompassed by said any one of a plurality of said retaining rings.

* * * * *